US005286088A

United States Patent [19]

Taylor et al.

[11] Patent Number: 5,286,088

[45] Date of Patent: Feb. 15, 1994

[54] UNDERSEAT MECHANISM FOR A CHAIR

[75] Inventors: Arthur G. Taylor, Darwen; Michael C. Hallmark, Dutton, both of England

[73] Assignee: Unit Press Limited, Blackburn, United Kingdom

[21] Appl. No.: 838,326

[22] Filed: Feb. 20, 1992

[51] Int. Cl.[5] ..... A47C 7/46

[52] U.S. Cl. ..... 297/353; 297/301; 297/328; 297/374

[58] Field of Search ..... 297/353, 301, 300, 328, 297/374

[56] References Cited

U.S. PATENT DOCUMENTS

| | | | |
|---|---|---|---|
| 4,062,587 | 12/1977 | Wolters . | |
| 4,143,910 | 3/1979 | Geffers et al. . | |
| 4,629,249 | 12/1986 | Yamaguchi | 297/301 X |
| 4,639,039 | 1/1987 | Donovan | 297/353 |
| 4,640,547 | 2/1987 | Fromme | 297/353 X |
| 4,693,514 | 9/1987 | Volkle | 297/374 |
| 4,786,108 | 11/1988 | Dauphin | 297/353 |
| 5,037,158 | 8/1991 | Crawford | 297/353 |

FOREIGN PATENT DOCUMENTS

| | | |
|---|---|---|
| 114600 | 8/1984 | European Pat. Off. . |
| 176816 | 4/1986 | European Pat. Off. . |
| 90/00871 | 2/1990 | PCT Int'l Appl. . |
| 401718 | 11/1933 | United Kingdom . |
| 2119641 | 11/1983 | United Kingdom . |
| 2125284 | 3/1984 | United Kingdom . |
| 2173696 | 10/1986 | United Kingdom . |
| 2193884 | 2/1988 | United Kingdom . |
| 2243772 | 11/1991 | United Kingdom . |

*Primary Examiner*—Philip C. Kannan
*Attorney, Agent, or Firm*—Fisher, Christen & Sabol

[57] ABSTRACT

An arrangement providing a backrest support pillar, particularly, though not exclusively, for an office chair whereby the height of a backrest can be selected by the user in a simple and ready manner using one hand. More particularly an arrangement is contemplated wherein the pillar is adjustable from a maximum length to a minimum length without resistance and is adjustable incrementally from that minimum length and automatically maintainable at a selected length. The invention also provides a seat/back synchronous tilt mechanism for a chair which eliminates the "shirt-lifting" effect of known chairs.

9 Claims, 8 Drawing Sheets

UNDERSEAT MECHANISM FOR A CHAIR

DISCLOSURE OF THE INVENTION

This invention relates to a chair, and is particularly concerned with office chairs. However, the invention is applicable to any piece of furniture which has a seat and a back. For example the invention could be applied to bar and comparable stools. In this specification, therefore, the word chair should be construed accordingly.

Chairs are known in which the sitter can recline by leaning backwards, thus causing the seat and back of the chair to move in synchronism towards a reclining position. Existing such mechanisms have disadvantages. A first disadvantage is that many are bulky and are very obviously visible beneath the chair seat, leading to an unattractive chair. Many also suffer from a "shirt lifting" disadvantage in that because of imperfect synchronism between the back and the seat, as the sitter reclines or sits up again the seat back exerts a slight upwards force on the users shirt. This can cause the shirt to be slowly drawn up in use and this can cause discomfort when the chair is used over a period of time. Further disadvantages of known mechanisms are that to achieve synchronism they use complicated and expensive underseat structures.

It is an object of the present invention to provide an synchronous seat/back tilt mechanism whereby one or more of the above disadvantages can be obviated or reduced.

The invention provides a synchronous seat/back tilt mechanism for a chair comprising a body support securable to a base of the chair, a seat support pivotally mounted relative to the body and a back support which at a rear thereof supports a back pillar, at an intermediate position thereof is pivoted to the seat support and at a forward end thereof is pivotally connected to the body.

The pivotal connection between the back support and the body should incorporate some lost-motion arrangement to account for the fact that the pivotal connection between the two supports moves about the point of connection of the seat support to the body and not about the pivotal connection between the back support and the body.

The seat base will normally be a column upstanding from a leg arrangement, but any convenient base can be used such as a frame or the like, provided room is left to allow the seat and back to tilt.

Desirably the pivotal connection between the seat support and the body is forwardly of a connection point between the body and the base. Desirably the pivot point is immediately in front of the connection point between the body and the base.

Desirably the pivot positions are chosen so that the ratio between the angle the seat support tilts and the angle the back support tilts is from 1:1.2 to 1:5. Desirably the ratio is 1:1.33.

With this mechanism, as the angle between the back and the seat increases the chord length between pressure points on the seat and on the back remains constant due to lowering of the back support and pillar. This is important in that it eliminates a tendency, apparent in many known chairs to raise the shirt of a sitter.

Preferably the seat support and the back support are nested channel section members, the body being disposed w thin the channel of the seat support and being rearwardly embraced by the front of the back support bracket.

Preferably the seat support and the back support are so nested that adjacent web portions thereof separate during backward tilting and spring means is provided to urge those webs together thus to provide a force on the mechanism tending to restore the seat support and back support to their rest positions. Conveniently, said spring loading can be adjustable manually to allow the user to adapt the mechanism.

The spring means can include a bar pivoted to the web of the seat support and passing through a slot in the back support, the other end of the rod having a handle and a compression spring being disposed around the rod, the position of the handle on the rod being movable to alter the force of the compression spring. Conveniently the handle can be threadedly engaged with the rod to effect such movement.

As a further feature of the invention there is provided a synchronous seat/back tilt mechanism for a chair which includes a seat support and a back support, wherein a pair of leaves, constituted by or provided on one of said supports is arranged to sandwich a leaf like member of the other support, there being provided a friction surface and means being provided to clamp the two leaves into braking and/or locking relationship with the leaf member of the other support.

The two leaves can have arcuate slots to permit relative movement of the two supports. The locking mechanism can comprise a clamp member.

The clamp member can include a bolt passing through the two leaves and the leaf member and having an enlarged head at one end and its other end being attached to a cam having an operating handle, movement of the handle causing the cam to clamp the leaves.

Alternatively, the bolt could have a thread and a screw handle could be provided to exert clamping device by means of a screw.

The invention also contemplates a back support pillar for a chair including a first pillar member and a second pillar member, one pillar member being connectable to a back support of the chair and the other pillar member being connectable to a back for the chair, one said member being slidable within the other, which other member provides longitudinally based notches cooperable with a catch which is resiliently urged transaxially towards said notches and movable between a ratchet position and a slide position, control of the catch being effected by a ball which engages between the catch and an endless groove on the other member, relative movement of the members towards minimum pillar length being effective to cause the catch to move to its ratchet position whence the pillar length can be increased stepwise and maintained at a selected number of lengths by inter-engagement between the catch and the notches, relative movement of the members to maximise pillar length causing the catch to move to its slide position in which pillar length can be reduced from maximum to minimum with no engagement between the catch and the notches.

The one member can include a bar together with a slide block or shoe which slides within the other member and which provides both the notches and the groove. The shoe can be moulded from plastics material to slide within a steel tube.

The catch member can have a nose on that side thereof which faces the notches and can be mounted in the other member for limited lateral movement.

The catch member can include an integral spring which bears against the other member during sliding movement. The one member can be attached to the back support and the other member attached to the back. Desirably, however, the other member is a tubular steel member which is connected to the back support and the one member is a bar carrying the shoe which engages within the steel tube and having a T-bar at its upper end. The tube can be rectangular.

This arrangement is compact, reliable, and has few parts.

The groove can be generally in the form of an elongated O-shape, having two parallel axial parts and top and bottom transitions. The transitions can be shaped in a manner to cause the catch to move between its two positions as a result of axial relative movement of the two members.

The invention will be described further, by way of example, with reference to the accompanying drawings wherein.

Figure 9:
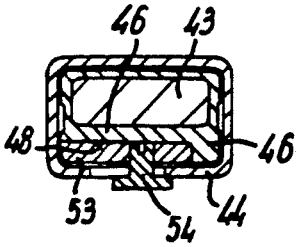
Figure 8:
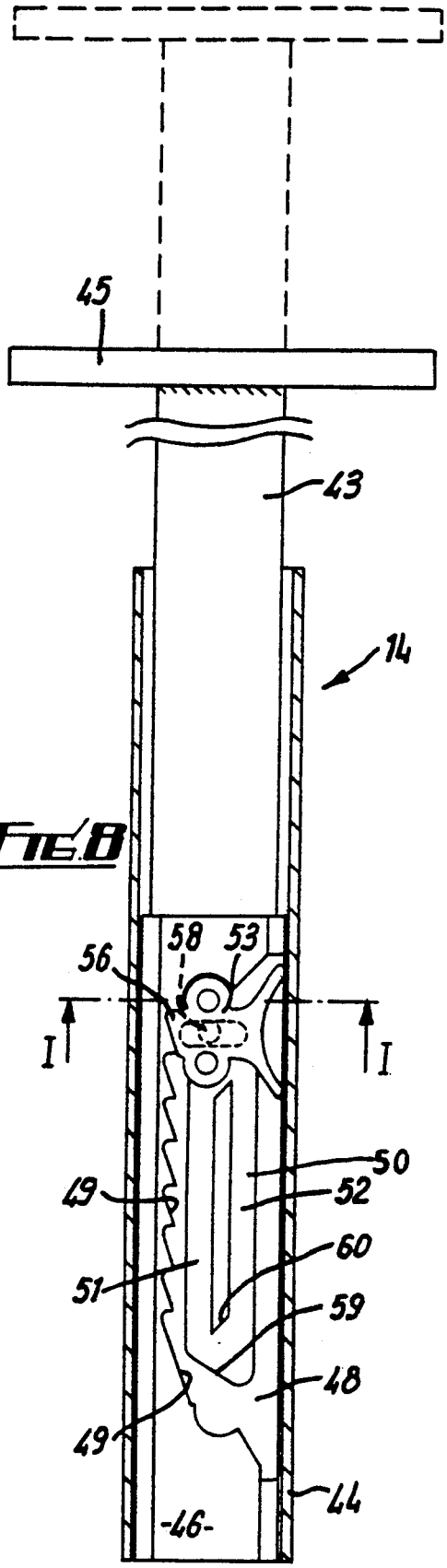
FIG. 8 is a view similar to FIG. 6 but with parts cut away and with the pillar in its minimum length configuration.
Figure 10:
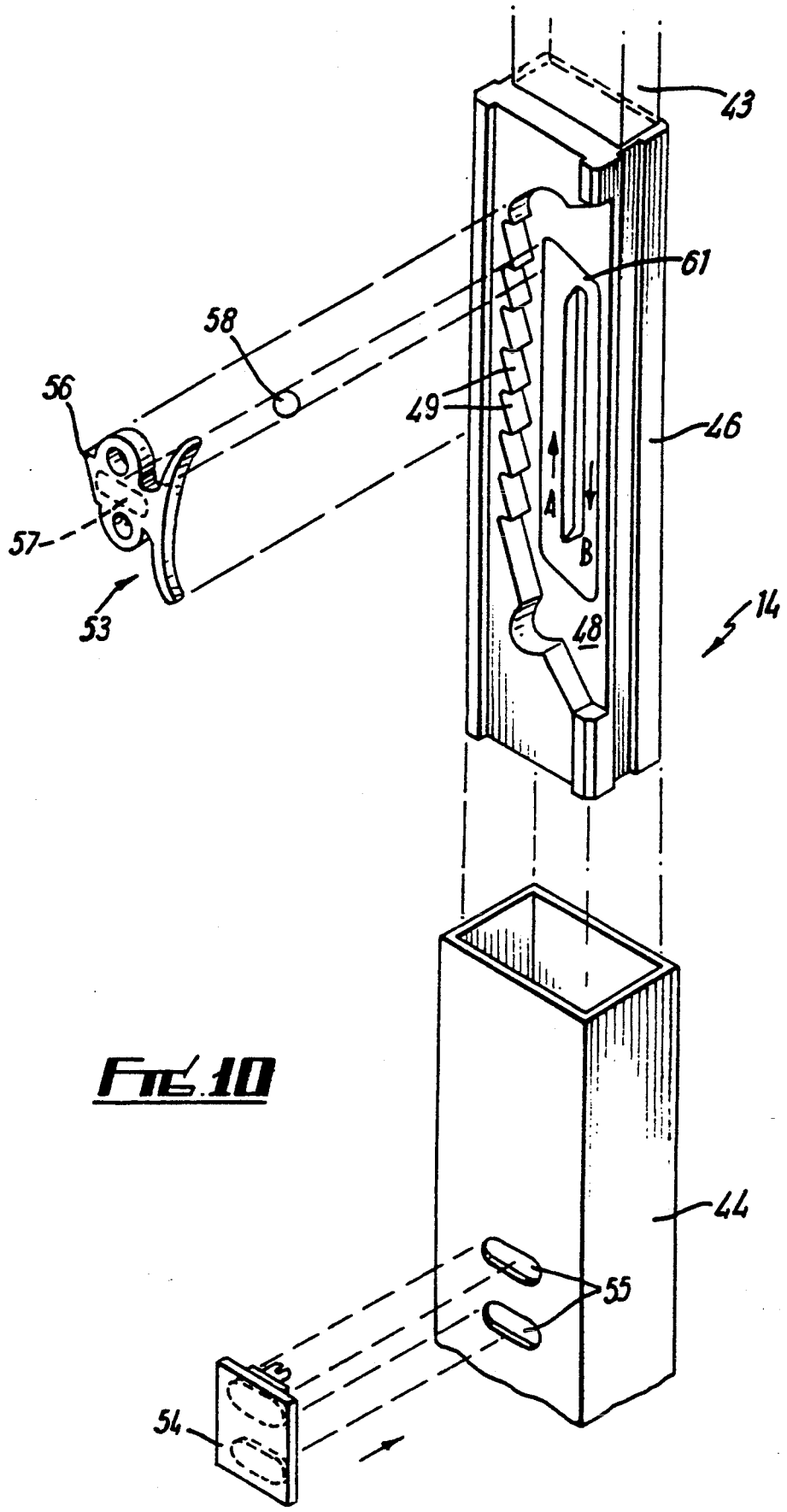

FIG. 9 a cross-sectional view on line I—I of FIG. 8;

FIG. 10 is an exploded view of the pillar mechanism of FIGS. 6 to 9.

Figure 11:
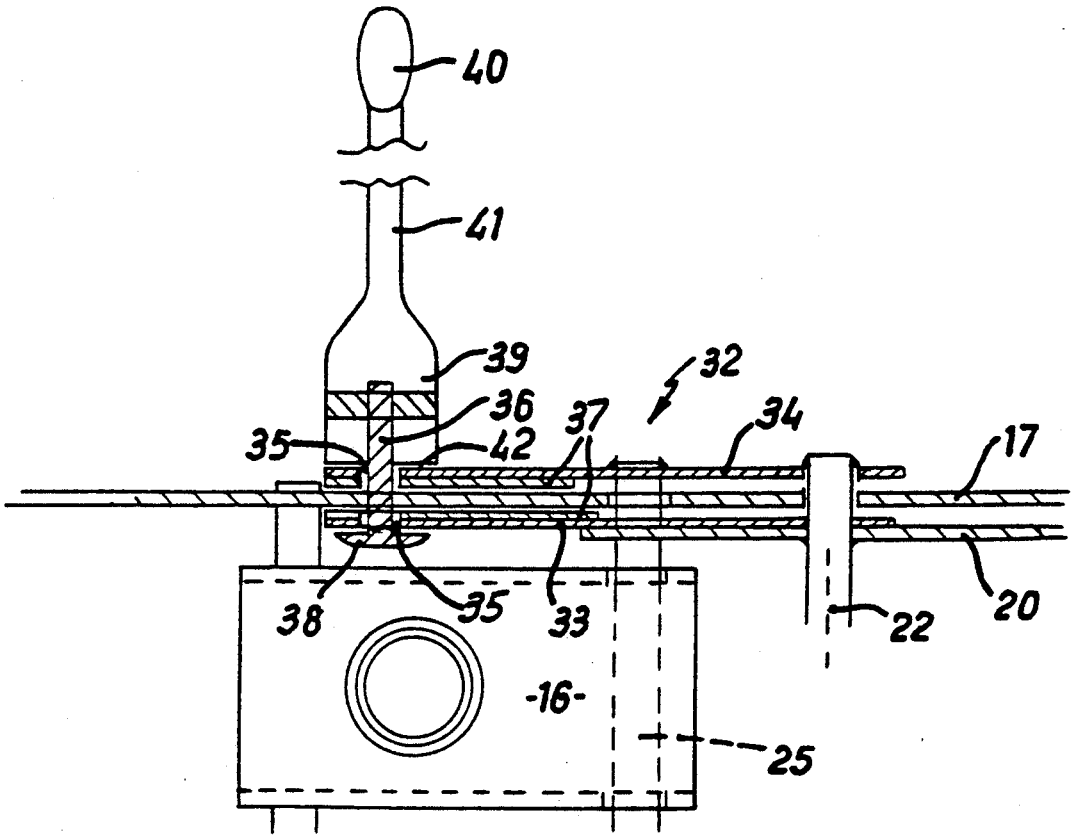
Figure 12:
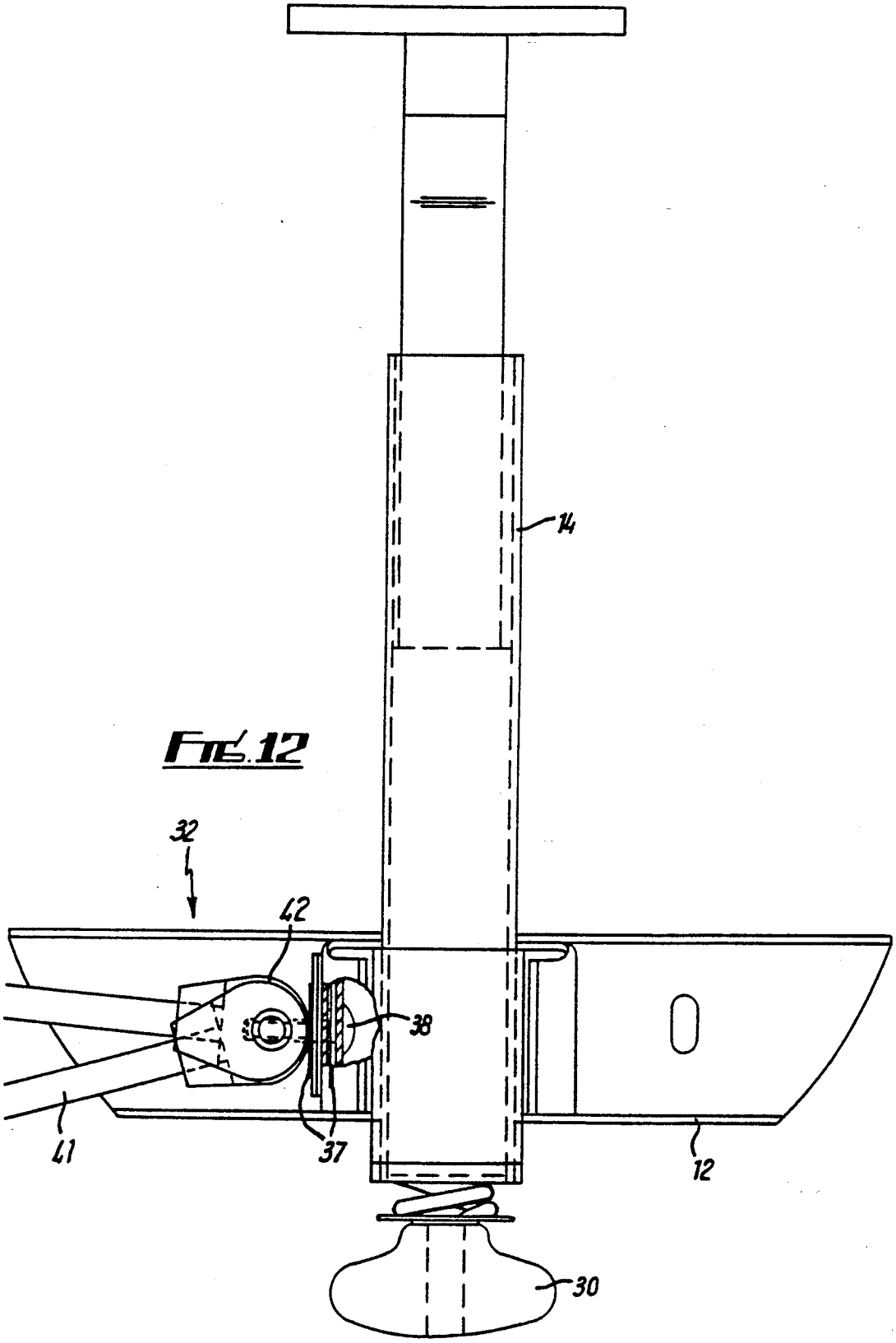

FIG. 11 is a schematic plan view of a lock mechanism suitable for use with the mechanism of the invention; and FIG. 12 is a fragmentary cross-sectional view of the lock mechanism.

Figure 2:
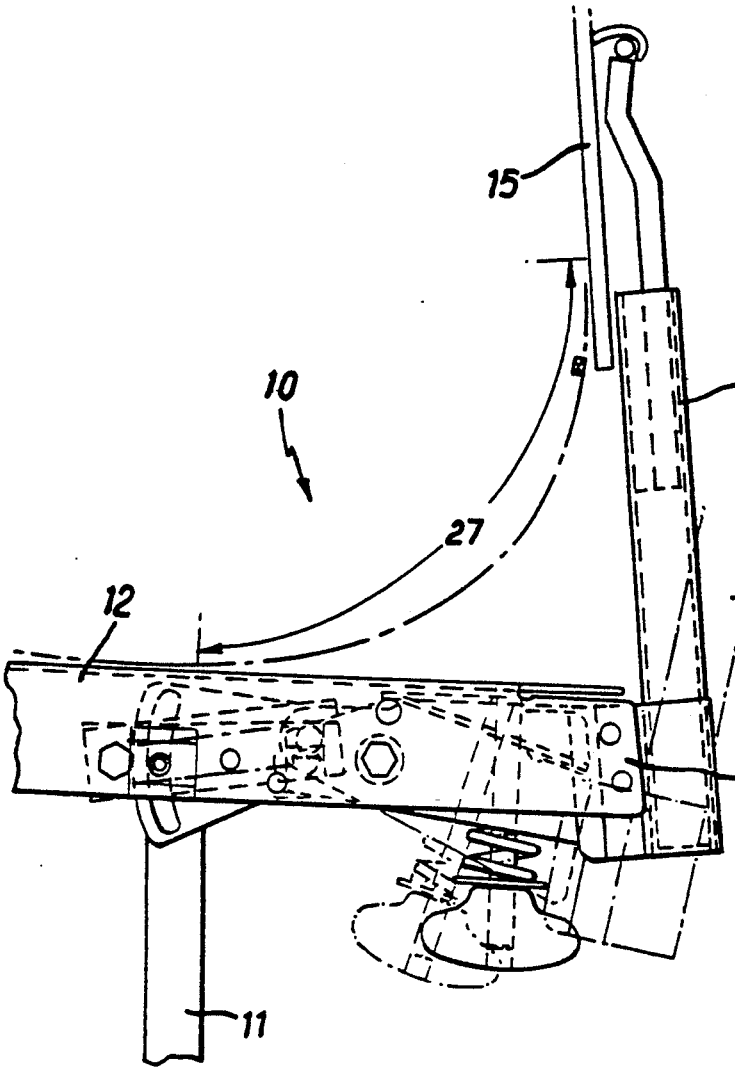
FIGS. 2 and 3 are views comparable to that of FIG. 1 on a reduced scale and showing the mechanism in two different positions.
Figure 3:
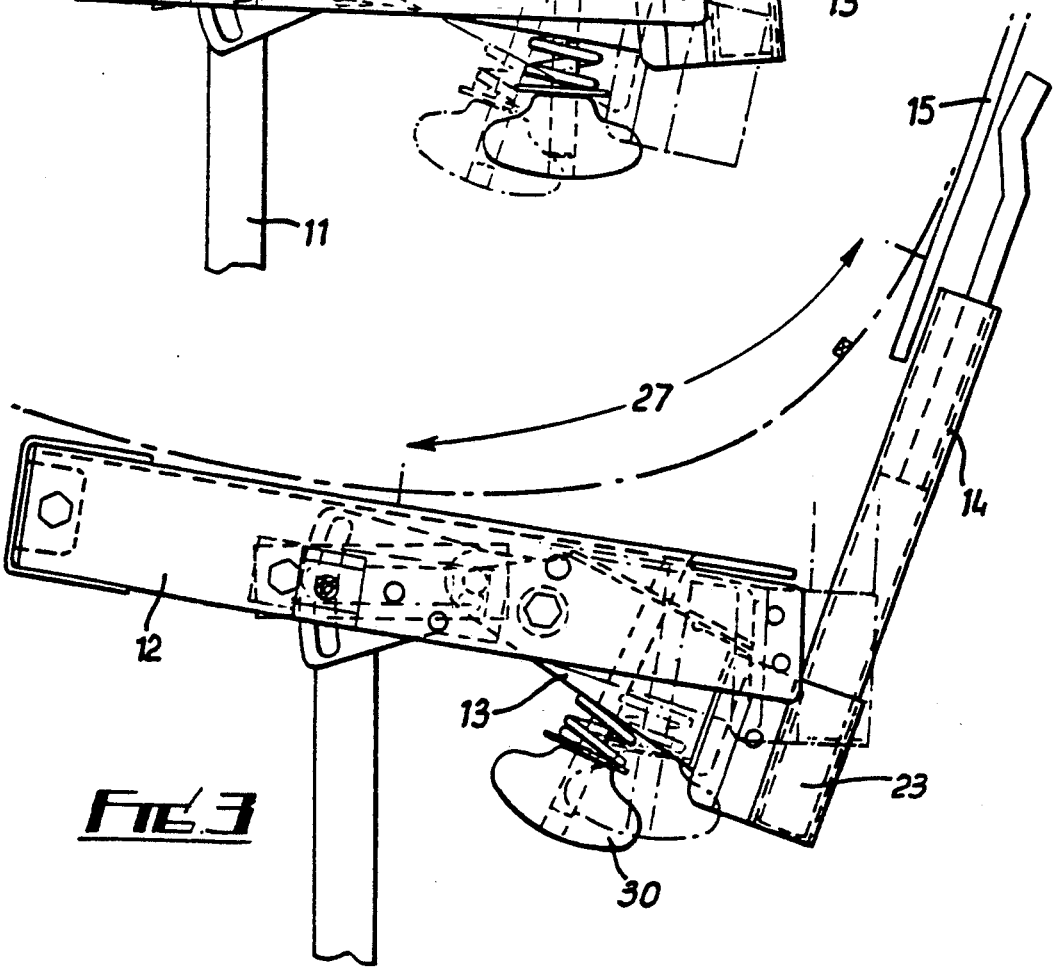

One aspect of the invention can best be initially described in its overall sense by reference to FIG. 2. A preferred seat mechanism 10 is mounted on a seat base which, in the embodiment shown is in the form of a column 11 which upstands from a leg or castor or comparable arrangement. A seat support 12 (to which will eventually be secured upholstery)is connected to a back support 13 which carries a backrest pillar 14 to whose upper end is limitedly pivotally mounted a conventional backrest 15. Important features of the invention will now be individually described.

THE SYNCHRO

As best seen in FIGS. 2, 3, 4 and 5, the synchronous movement of the seat and back is achieved by a simple interconnection of parts. The column 11 mounts a body 16 which is in the form of a short length of 50 mm × 25 mm rectangular steel rube. Column 11 is received within a tubular recess provided in the body 16. The seat support 12 is in the form of an inverted U-shaped channel member made from sheet metal having flanges 17 and a web 18. The seat support 12 is pivoted to the body 16 at a position which is just forwardly of and close to the position of attachment of the column 11. The pivot point 19 is so placed so as to be as near as possible directly beneath the centre of gravity of a sitter. Back support 13 is also in the form of an inverted U-section member made of sheet metal and has flanges 20 and a web 21. At its rear the support 13 carries a socket 23 which in turn mounts a backrest pillar 14. At their forward ends the flanges 20 of the support 13 carry a pin 25 which is pivotally engaged with the body 16 by passing through aligned rectangular apertures 26. This lost-motion arrangement allows the back support 13 to pivot freely without binding.

Figure 4:
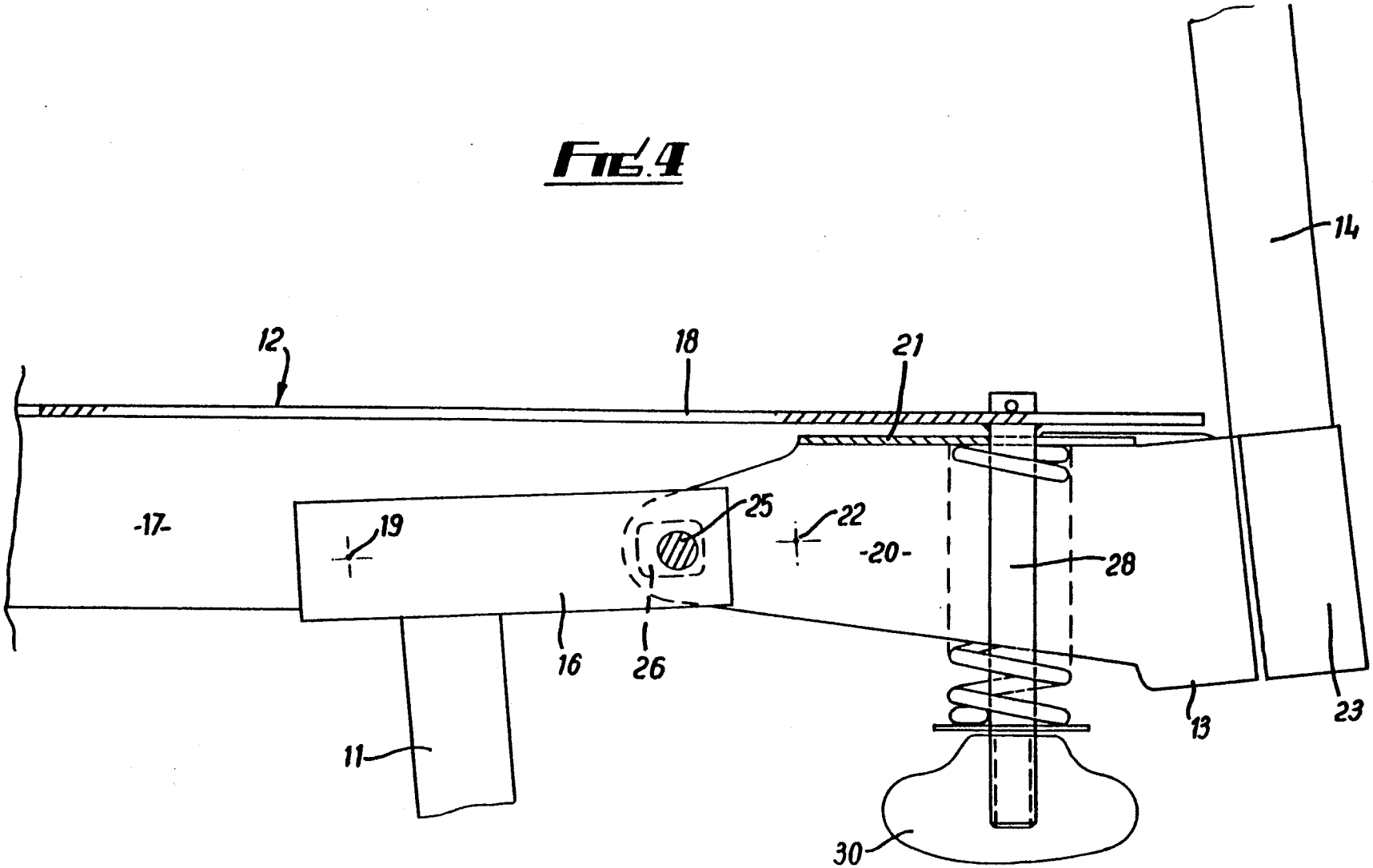
FIGS. 4 and 5 are enlarged fragmentary cross-sectional views illustrating essentials of the synchronous mechanisms.
Figure 5:
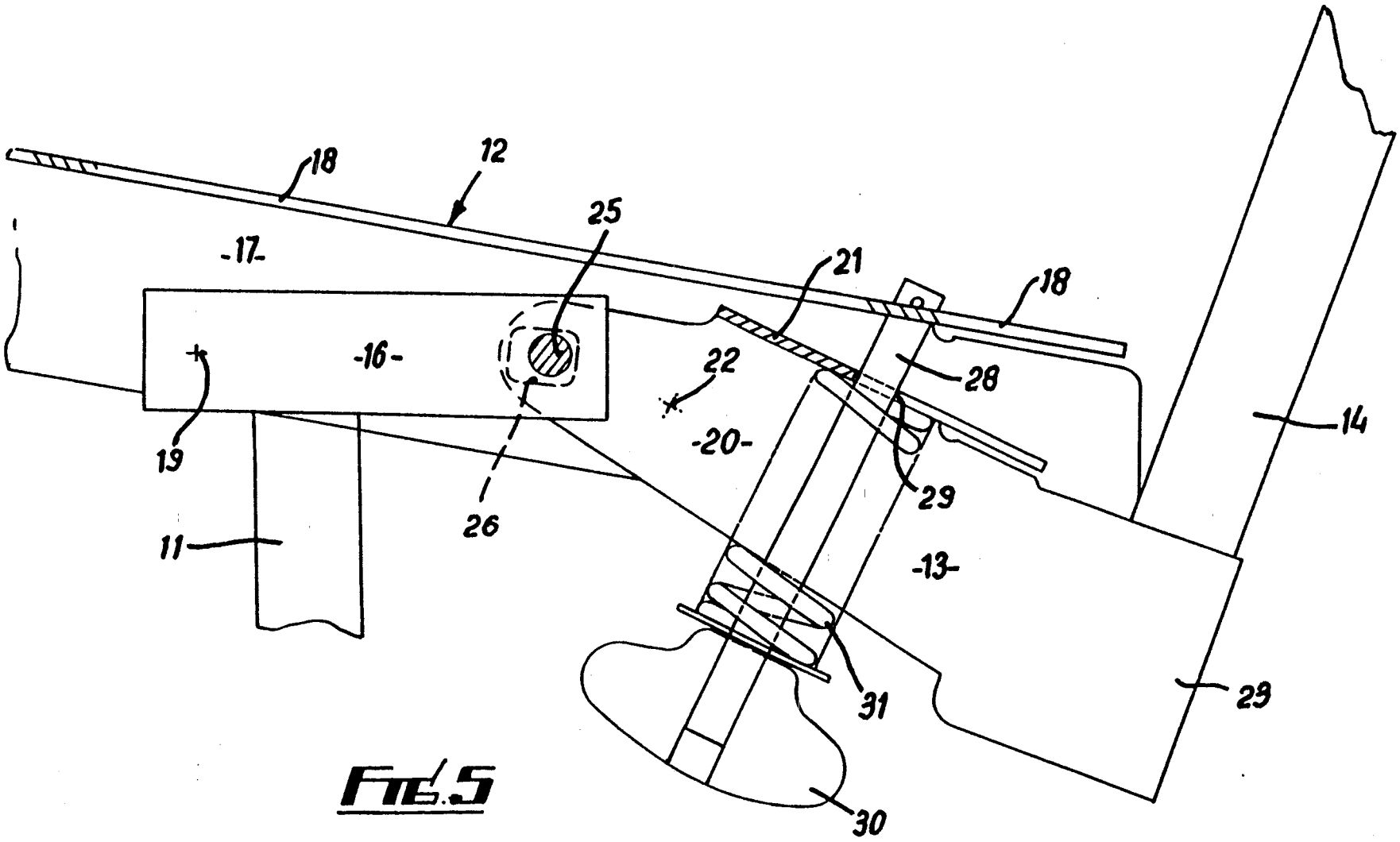
Figure 6:
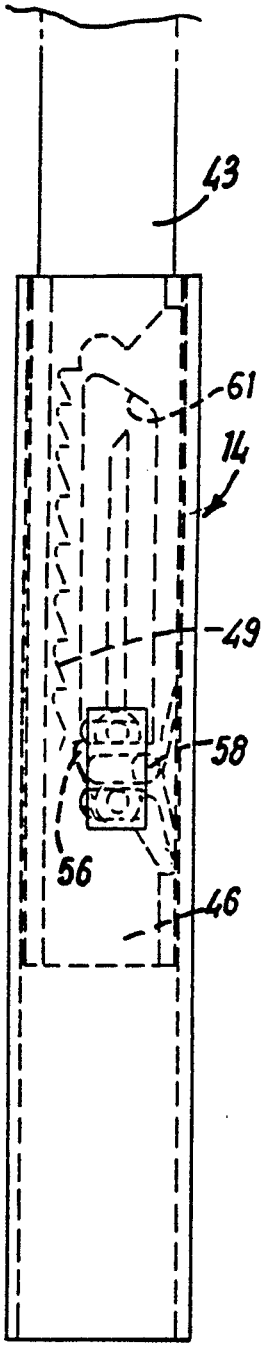
FIG. 6 is a front elevation of part of a seat pillar according to the invention at its maximum length.
Figure 7:
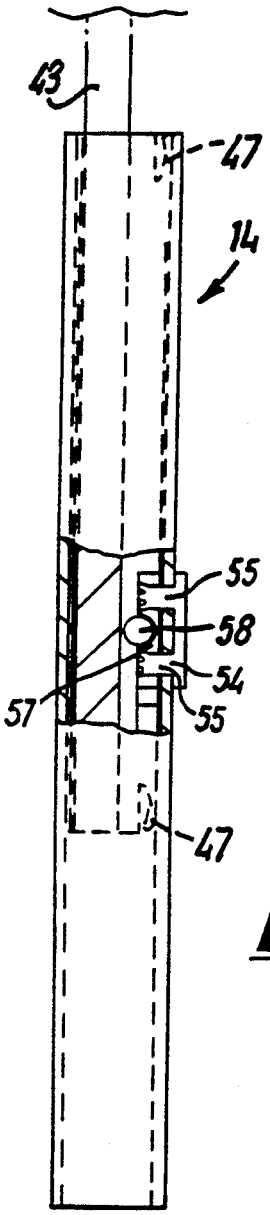
FIG. 7 is a side elevation of the pillar in its FIG. 6 condition.

As will be seen from a comparison of FIGS. 4 and 5, when a sitter leans backwards the seat support 12 begins to tilt about point 19 and by its engagement at point 22 draws the back support 13 downwardly also. Because its front end cannot move downwards because of the pin 25 engaging apertures 26, the rear of support 13 is compelled to move downwards causing the seat pillar to tilt rearwardly and also (very importantly) to move downwards relative to the seat support 12. This combined pivotal and downward movement ensures that the length of the chord 27 (see FIGS. 2 and 3) remains constant so that the mechanism does not exert a shirt lifting effect on the user.

FIGS. 4 and 5 also illustrate a very convenient return/tension arrangement which results from the construction of the seat support 12 and the back support 13 as nested inverted U-section members. As will be appreciated from a consideration of FIGS. 4 and 5, web 21 of the back support 13 moves away from and towards a rear portion of the web 18 of the seat support during tilting movement. It is very simple, therefore, to add a return and tension arrangement by attaching a rod 28 pivotally to a rear portion of the web 18 which rod passes through a slot 29 in the web 21 and has a handle 30 at its far end.

Handle 30 can be moved longitudinally of the rod 28 to compress a compression spring 31 to a greater or lesser degree. The handle 30 is desirably threaded on the rod 28, but a series of detents or other comparable mechanism could be used. Thus, the sitter can adjust the strength of the spring so that the sitters weight is very conveniently balanced by just the right amount of spring return force. This is a particularly cheap and simple mechanism and does not require the use of gas springs or other devices which have previously been used.

THE LOCK

Reference will now be made to FIGS. 11 and 12 wherein a lock/brake arrangement 32 is provided which can lock the synchronous mechanism, that is to say the relative positions of the supports 12 and 13 in any desired position at the will of the sitter.

Figure 1:
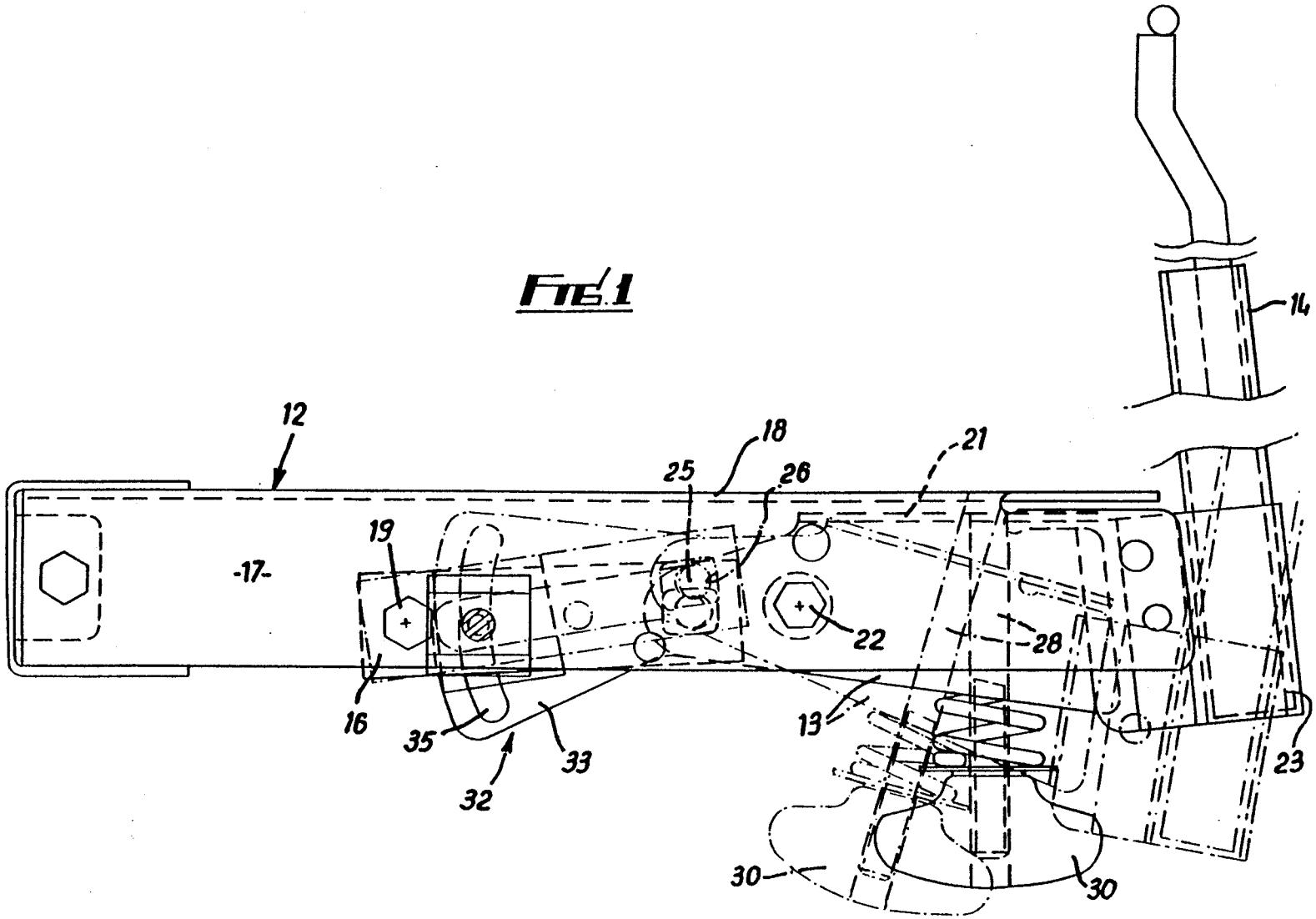
FIG. 1 is a side elevation of a preferred mechanism of the invention.

Referring to FIG. 11, it will be seen that the flange 20 has attached thereto a pair of truncated triangular leaves 33 and 34. Leaves 33, 34 are arranged to be adjacent the leaf-like flange 17 of the seat support 12. Leaf 34 is supported by attachment to flange 20 by means of the pin 25 and the pin which is disposed on axis 22. As best seen in FIG. 1, the leaves 33,34 have arcuate slots 35 which, as the mechanism pivots, move relative to a bolt 36 which passes through an aperture in the flange 17. The surfaces of the leaves 33 and 34 which face the flange 17 are provided with a friction material 37 which can be a rubber material, a rubberised fabric, or any conventional brake material which will give a good grip on the metal of flange 17. Of course, if desired the friction material can be on flange 17 alone or on both the flange 17 and on the leaves 33, 34.

The bolt 36 is connected to means whereby the two leaves 33, 34 can be moved to clamp flange 17. One possibility would be to have a thread on the bolt 36 and have a handle which will be screwed by the user to cause clamping. A desirable alternative, however, is for the end of the bolt 36 remote from its head 38 to be pivotally attached to a cam 39 which has a handle 40 at the end of an arm 41. Pivoting of the cam 39 relative to the bolt 36 causes cam surface 42 to urge the leaves 33,34 into clamping relationship with the flange 17.

The lock arrangement of the invention is particularly simple and easy to manufacture in that it does not require many parts and is greatly facilitated by the nested channel nature of the two supports.

NO TOUCH PILLAR

FIGS. 6 to 10 illustrate a preferred "no touch" backrest raising and lowering arrangement of the invention. This is a system which allows the user to select the height of the backrest using one hand. When the pillar is moved to its maximum length it is internally freed so that it can be reduced to its minimum length without resistance. Incremental increases in its length from its minimum up to its maximum can then be made by the user to suit the user. There are many known arrangements for effecting this movement, but most are expensive, complicated, bulky and some are open so as to present a danger to a users fingers.

The preferred pillar 14 of the invention has a first member in the form of a bar 43 which can telescopically slide within a second pillar member in the form of a hollow rectangular steel tube 44. It should be understood that although the tube 44 will be described as being attached to a pillar support socket 23 and the bar 43 will be described as having a horizontal T-piece 45 for attachment to a backrest, the two positions could be reversed, with the backrest being attached to the top of the tube 44 and the bar 43 protruding downwardly from the tube 44 to be secured to the support socket 23.

The bar 43 carries a shoe 46 which is in the form of a plastic moulding, for example of nylon or the like, which is dimensioned to be a smooth sliding fit within the tube 44. To reduce any tendency of the shoe 46 to tilt, at its upper and lower ends it is provided with integrally moulded spring tongues 47 which are compressed by its containment within the tube 44 and bear outwardly on the tube 44 to resist tilting and reduce free motion.

The shoe 46 has a recess 48 formed therein. One wall of the recess 48 is provided with a plurality of notches 49 whilst the opposite side of the recess is free for a purpose which will later be described. The base of the recess is provided with an endless groove 50 which has a pair of spaced-apart axially parallel parts 51 and 52. The lower portion of the recess 48 has a deflection surface 49.

A catch 53 is of depth equal to the depth of the recess 48 in shoe 46 and is mounted so as to be limitedly transaxially movable by a pin plate 54 which has two pins which pass through slots 55 in the wall of tube 44 (FIG. 10). The catch 53 has a nose 56 for engaging the notches 49 and a semi-cylindrical channel 57 which accommodates half of a ball 58. A portion of the catch 53 remote from the nose 56 is so constructed and dimensioned as to constitute a bow spring having two arms which bear against the wall of tube 44 and urge the catch 53 into engagement with the notches 49. The other half of the ball 58 is engaged within the endless groove 50 formed in the base of recess 48.

Operation of the pillar 14 will now be described. In the FIG. 6 condition it will be seen that the bar 43 and the shoe 46 are at their uppermost position and the pillar is at its maximum length. Surface 49 has engaged nose 56, compressed the bow spring and moved the catch 53 to the right. Ball 58 has been deflected by a lower wall 59 of the endless groove 50 so as to lie beneath part 52 of the groove 50. When the bar 43 is moved downwards, by manual movement of the chair backrest, the ball 58 enters elongate part 52 of the groove 50, entry into that part being encouraged by the surface 60. Once the ball is within the part 52 the nose is held away from the notches 49 and therefore the bar 43 can move downwardly until the pillar 14 reaches its minimum length.

At this stage (shown in FIG. 8) the ball 58 has become free of the top edge of the portion 52 and therefore the bow spring is free to move the catch 53 to the left so that its nose 56 engages in the top notch 49. The ball is also moved in this way by engagement with the slanting top surface 61 of the groove 50 so that it is disposed above the part 51 of the groove 50. When the bar 43 and the shoe 46 are now lifted by the user, the ball 58 engages within portion 51 of the groove 50 and the nose 56 is in ratchet relationship with the series of notches 49. The user can then lift the backrest until it is at a convenient height to use and then leave the backrest at that height. Engagement of a notch 49 with the nose 56 prevents any further downward movement of the backrest.

As will be appreciated, this mechanism contains very few parts, six in all including the tube, the bar, the shoe, the ball, the catch and the pin plate. The mechanism is very compact in that it can virtually all be accommodated within the tube 44. A chair pillar made in accordance with this invention can be substituted in many existing chairs without altering upholstery or other items such as camouflaging concertinas or the like.

Because the mechanism essentially only contains plastics (for example nylon) sliding against steel, lubrication problems are minimal and corrosion is unlikely.

The invention is not limited to the precise details of the foregoing and variations can be made thereto within the scope of the invention.

What is claimed is:

1. A back support pillar for a chair including a first pillar member and a second pillar member, one pillar member being connectable to a back support of the chair and the other pillar member being connectable to a back for the chair, one said member being slidable within the other, which other member provides longitudinally spaced notches cooperable with a catch which is resiliently urged transaxially towards said notches and movable between a ratchet position and a slide position, control of the catch being effected by a ball which engages between the catch and an endless groove on the other member, relative movement of the members towards minimum pillar length being effective to cause the catch to move to its ratchet position whence the pillar length can be increased stepwise and maintained at a selected number of lengths by inter-engagement between the catch and the notches, relative movement of the members to maximise pillar length causing the catch to move to its slide position in which pillar length can be reduced from maximum to minimum with no engagement between the catch and the notches.

2. A pillar as claimed in claim 1 wherein the one member includes a bar together with a slide which slides within the other member and which provides both the notches and the groove.

3. A pillar as claimed in claim 2 wherein the slide is moulded from plastics material to slide within a steel tube.

4. A pillar as claimed in claim 1 wherein the catch member has a nose on that side thereof which faces the notches and is mounted in the other member for limited lateral movement.

5. A pillar as claimed in claim 1 wherein the catch member includes an integral spring which bears against the other member during sliding movement.

6. A pillar as claimed in claim 1 wherein the one member is attached to the back support and the other member is attached to the back.

7. A pillar as claimed in claim 1 wherein the other member is a tubular steel member which is connected to the back support and the one member is a bar carrying the shoe which engages within the steel tube and has a T-bar at its upper end.

8. A pillar as claimed in claim 1 wherein the groove is generally in the form of an elongated 0-shape, having two parallel axial parts and top and bottom transitions.

9. A pillar as claimed in claim 8 wherein the transitions are shaped in a manner to cause the catch to move between its two positions as a result of axial relative movement of the two members.

* * * * *